US011128945B2

(12) United States Patent
Hua et al.

(10) Patent No.: US 11,128,945 B2
(45) Date of Patent: Sep. 21, 2021

(54) LOUDSPEAKER AND METHOD FOR IMPROVING DIRECTIVITY, HEAD-MOUNTED DEVICE AND METHOD

(71) Applicant: Goertek Inc., Shandong Province (CN)

(72) Inventors: Yang Hua, Shandong Province (CN); Ze Wang, Shandong Province (CN); Hongwei Zhou, Shandong Province (CN); Dehua Li, Shandong Province (CN)

(73) Assignee: Goertek Inc., Shandong (CN)

( * ) Notice: Subject to any disclaimer, the term of this patent is extended or adjusted under 35 U.S.C. 154(b) by 0 days.

(21) Appl. No.: 16/312,098

(22) PCT Filed: Dec. 31, 2016

(86) PCT No.: PCT/CN2016/114052
§ 371 (c)(1),
(2) Date: Dec. 20, 2018

(87) PCT Pub. No.: WO2018/058845
PCT Pub. Date: Apr. 5, 2018

(65) Prior Publication Data

US 2019/0230430 A1 Jul. 25, 2019

(30) Foreign Application Priority Data

Sep. 30, 2016 (CN) ..... 201610875040.X

(51) Int. Cl.
*H04R 1/10* (2006.01)
*H04R 3/08* (2006.01)
(Continued)

(52) U.S. Cl.
CPC ..... *H04R 1/1075* (2013.01); *H04R 1/2811* (2013.01); *H04R 3/00* (2013.01);
(Continued)

(58) Field of Classification Search
CPC ..... H04R 1/1075; H04R 1/2811; H04R 3/00; H04R 3/08; H04R 5/033; H04R 2430/00
(Continued)

(56) References Cited

U.S. PATENT DOCUMENTS 5,115,882 A * 5/1992 Woody ..... H04R 1/345 181/144
6,817,440 B1 11/2004 Kim
(Continued)

FOREIGN PATENT DOCUMENTS

CN 1435073 A 8/2003
CN 2712026 Y 7/2005
(Continued)

OTHER PUBLICATIONS

International Searching Authority, International Search Report in Application No. PCTCN2016114052, dated May 4, 2018.
(Continued)

*Primary Examiner* — William A Jerez Lora
(74) *Attorney, Agent, or Firm* — LKGIobal | Lorenz & Kopf, LLP

(57) ABSTRACT

The present disclosure discloses a loudspeaker and a method for improving directivity of a sound of a loudspeaker, a head-mounted device and a method for improving a sound effect of a head-mounted device. The loudspeaker comprises: a housing, a magnetic circuit unit that is provided within the housing and is for generating a magnetic force, a voice coil that vibrates by the magnetic force, and a vibrating diaphragm that in response to the vibration of the voice coil vibrates and generates a sound; wherein the loudspeaker further comprises a curved-surface extension structure; the curved-surface extension structure connects to the vibrating diaphragm, and radiating the sound generated by the vibrating diaphragm into a predetermined directivity range.

5 Claims, 3 Drawing Sheets

(51) Int. Cl.
*H04R 1/28* (2006.01)
*H04R 5/033* (2006.01)
*H04R 3/00* (2006.01)

(52) U.S. Cl.
CPC ..... *H04R 3/08* (2013.01); *H04R 5/033* (2013.01); *H04R 2430/00* (2013.01)

(58) Field of Classification Search
USPC ..... 381/61, 387
See application file for complete search history.

(56) References Cited

U.S. PATENT DOCUMENTS

| | | | | |
|---|---|---|---|---|
| 9,596,544 | B1 * | 3/2017 | Brotherton | H04R 19/02 |
| 2004/0218775 | A1 * | 11/2004 | Huang | H04R 5/033 381/371 |
| 2008/0130933 | A1 * | 6/2008 | Hayashi | H04R 1/345 381/354 |
| 2012/0219165 | A1 | 8/2012 | Yamada et al. | |
| 2013/0216074 | A1 | 8/2013 | Kon | |
| 2017/0142243 | A1 | 5/2017 | Hua et al. | |
| 2018/0192226 | A1 * | 7/2018 | Woelfl | G10K 11/17815 |
| 2018/0192228 | A1 * | 7/2018 | Woelfl | H04R 1/1083 |

FOREIGN PATENT DOCUMENTS

| | | | |
|---|---|---|---|
| CN | 101080107 | A | 11/2007 |
| CN | 101835072 | A | 9/2010 |
| CN | 102665156 | A | 9/2012 |
| CN | 103155594 | A | 6/2013 |
| CN | 203416387 | U | 1/2014 |
| CN | 104052851 | A | 9/2014 |
| CN | 205320245 | U | 6/2016 |
| CN | 105979441 | A | 9/2016 |

OTHER PUBLICATIONS

National Intellectual Property Administration, Office Action in Application No. 201610875040.X dated Sep. 30, 2018.

* cited by examiner

LOUDSPEAKER AND METHOD FOR IMPROVING DIRECTIVITY, HEAD-MOUNTED DEVICE AND METHOD

CROSS REFERENCE TO RELATED APPLICATIONS

This application is a U.S. National Stage entry under 35 U.S.C. § 371 based on International Application No. PCT/CN2016/114052, filed on Dec. 31, 2016, which was published under PCT Article 21(2) and which claims priority to Chinese Patent Application No. 201610875040.X, filed on Sep. 30, 2016. These applications are hereby incorporated herein in their entirety by reference.

TECHNICAL FIELD

This application pertains to the technical field of head-mounted devices, and particularly relates to a loudspeaker and a method for improving directivity of a sound of a loudspeaker, a head-mounted device and a method for improving a sound effect of a head-mounted device.

BACKGROUND

Currently popular head-mounted devices, for example, AR (Augmented Reality) headpieces or VR (Virtual Reality) headpieces, can provide a very good immersion-type sound experience by using semi-closed or totally closed earphone systems, which facilitates presenting the three-dimensional effect together with the vision. In conventional head-mounted devices, commonly used sound playing devices include the following. Earplug systems, which are compact and have good leak proofness, but have the defects are that they cannot utilize the auricle feature and the three-dimensional sound effect is not ideal. Earmuff systems, which have good three-dimensional sound effect, but such products have relatively cumbersome appearances, and are discomfort after long-term wearing, and they are adverse to the interaction between the user and the sounds of the surrounding environment, and thus are not suitable for non-alone players or outdoor applications. Bone conduction and externally playing loudspeaker systems, which can free the two ears of the wearer, but bone conduction devices have a poor sound performance, and cannot reach a good sound immersion feeling, and traditional externally playing loudspeakers have not progressed to a small extent in privacy protection.

Therefore, badly needed is a solution that improves the immersion-type experience of AR/VR devices and provides the privacy protection of the sound contents in the immersion process of the user. In addition, other objects, desirable features and characteristics will become apparent from the subsequent summary and detailed description, and the appended claims, taken in conjunction with the accompanying drawings and this background.

SUMMARY

The present disclosure provides a loudspeaker and a method for improving directivity of a sound of a loudspeaker, a head-mounted device and a method for improving a sound effect of a head-mounted device, to solve or partially solve the problems of head-mounted devices such as poor sound receiving privacy and poor user experience.

According to an aspect of the present disclosure, there is provided a loudspeaker, wherein the loudspeaker comprises: a housing, a magnetic circuit unit that is provided within the housing and is for generating a magnetic force, a voice coil that vibrates by the magnetic force, and a vibrating diaphragm that in response to the vibration of the voice coil vibrates and generates a sound; wherein the loudspeaker further comprises a curved-surface extension structure; and the curved-surface extension structure connects to the vibrating diaphragm, and the sound generated by the vibrating diaphragm radiates into a predetermined directivity range via the curved-surface extension structure.

According to another aspect of the present disclosure, there is provided a head-mounted device, comprising a micro-controlling unit, wherein the head-mounted device further comprises: an even number of the loudspeakers of an aspect of the present disclosure; and the loudspeakers are provided at predetermined positions of the head-mounted device and are symmetrical.

Optionally, the loudspeakers are two loudspeakers, and the two loudspeakers are respectively provided at positions of the head-mounted device that correspond to a left ear and a right ear of a user;

or, the loudspeakers are four loudspeakers, and the four loudspeakers are respectively provided at positions of the head-mounted device that correspond to left front, left rear, right front and right rear of an ear of a user.

Optionally, the micro-controlling unit is for, measuring in real time an amplitude frequency response A1 and a phase frequency response P1 of each of the loudspeakers that are worn adjacent to an ear of a user, and after the loudspeaker receives a sound signal that has direction information θ1 and distance information Δ1, searching an in-advance-prepared set of Head Related Transfer Function HRTF for an HRTF function that matches the direction information θ1 and the distance information Δ1, and compensating for a sound signal outputted by the loudspeaker by using the HRTF function obtained by the searching.

Optionally, when the loudspeakers are four loudspeakers, the micro-controlling unit is for, selecting from a loudspeaker A and a loudspeaker B that are located on the left the loudspeaker A, drawing a circle with the loudspeaker B as a circle center and a connecting line of the loudspeaker A and the loudspeaker B as a radius, drawing a reverse direction extension line that passes through the loudspeaker B in a direction of a known sound source, determining a position where a circumference of the circle and the reverse direction extension line intersect as a virtual loudspeaker A' of the loudspeaker A, forming a new array by using the loudspeaker A and the virtual loudspeaker A', defining a directivity angle of the new array as a first collecting angle, and pointing the first collecting angle to a direction that is confirmed by a second collecting angle that has been confirmed as having a voice characteristic in the direction of the known sound source;

and, selecting from a loudspeaker C and a loudspeaker D that are located on the right the loudspeaker C, drawing a circle with the loudspeaker D as a circle center and a connecting line of the loudspeaker C and the loudspeaker D as a radius, drawing a reverse direction extension line that passes through the loudspeaker D in a direction of a known sound source, determining a position where a circumference of the circle and the reverse direction extension line intersect as a virtual loudspeaker C' of the loudspeaker C, forming a new array by using the loudspeaker C and the virtual loudspeaker C', defining a directivity angle of the new array as a third collecting angle, and pointing the third collecting angle to a direction that is confirmed by a fourth collecting angle that has been confirmed as having a voice characteristic in the direction of the known sound source.

Optionally, each of the loudspeakers corresponds to an initial directivity range, and the micro-controlling unit is for, regulating a signal amplitude of the loudspeaker when it is determined that the sound outputted by the loudspeaker exceeds the initial directivity range.

According to yet another aspect of the present disclosure, there is provided a method for improving directivity of a sound of a loudspeaker, wherein the loudspeaker comprises: a housing, a magnetic circuit unit that is provided within the housing and is for generating a magnetic force, a voice coil that vibrates by the magnetic force, and a vibrating diaphragm that in response to the vibration of the voice coil vibrates and generates a sound; wherein the method comprises:

providing a curved-surface extension structure in the loudspeaker; and connecting the curved-surface extension structure to the vibrating diaphragm, and radiating the sound generated by the vibrating diaphragm into a predetermined directivity range.

According to yet another aspect of the present disclosure, there is provided a method for improving a sound effect of a head-mounted device, wherein the method comprises:

providing symmetrically at predetermined positions of the head-mounted device an even number of the loudspeakers of an aspect of the present disclosure.

Optionally, the providing symmetrically at predetermined positions of the head-mounted device an even number of the loudspeakers comprises:

providing the loudspeakers respectively at positions of the head-mounted device that correspond to a left ear and a right ear of a user;

or, providing the loudspeakers respectively at positions of the head-mounted device that correspond to left front, left rear, right front and right rear of an ear of a user.

Optionally, the method further comprises:

measuring in real time an amplitude frequency response A1 and a phase frequency response P1 of each of the loudspeakers that are worn adjacent to an ear of a user, and after the loudspeaker receives a sound signal that has direction information θ1 and distance information Δ1, searching an in-advance-prepared set of Head Related Transfer Function HRTF for an HRTF function that matches the direction information θ1 and the distance information Δ1, and compensating for a sound signal outputted by the loudspeaker by using the HRTF function obtained by the searching.

The advantageous effects of the present disclosure are: the loudspeaker of the embodiments of the present disclosure, by comprising a curved-surface extension structure, which radiates the sound generated by the vibrating diaphragm of the loudspeaker into a predetermined directivity range, compared with the earplug or earmuff system in the conventional head-mounted devices, has a small volume and is comfortable to wear. In addition, compared with traditional externally playing loudspeakers, the directivity is better, which improves the privacy in sound receiving, optimizes the user experience, and, compared with bone conduction earphones, does not affect the head-mounted device in providing a good sound immersion feeling.

BRIEF DESCRIPTION OF DRAWINGS

The present invention will hereinafter be described in conjunction with the following drawing figures, wherein like numerals denote like elements, and.

DETAILED DESCRIPTION

Figure 1:
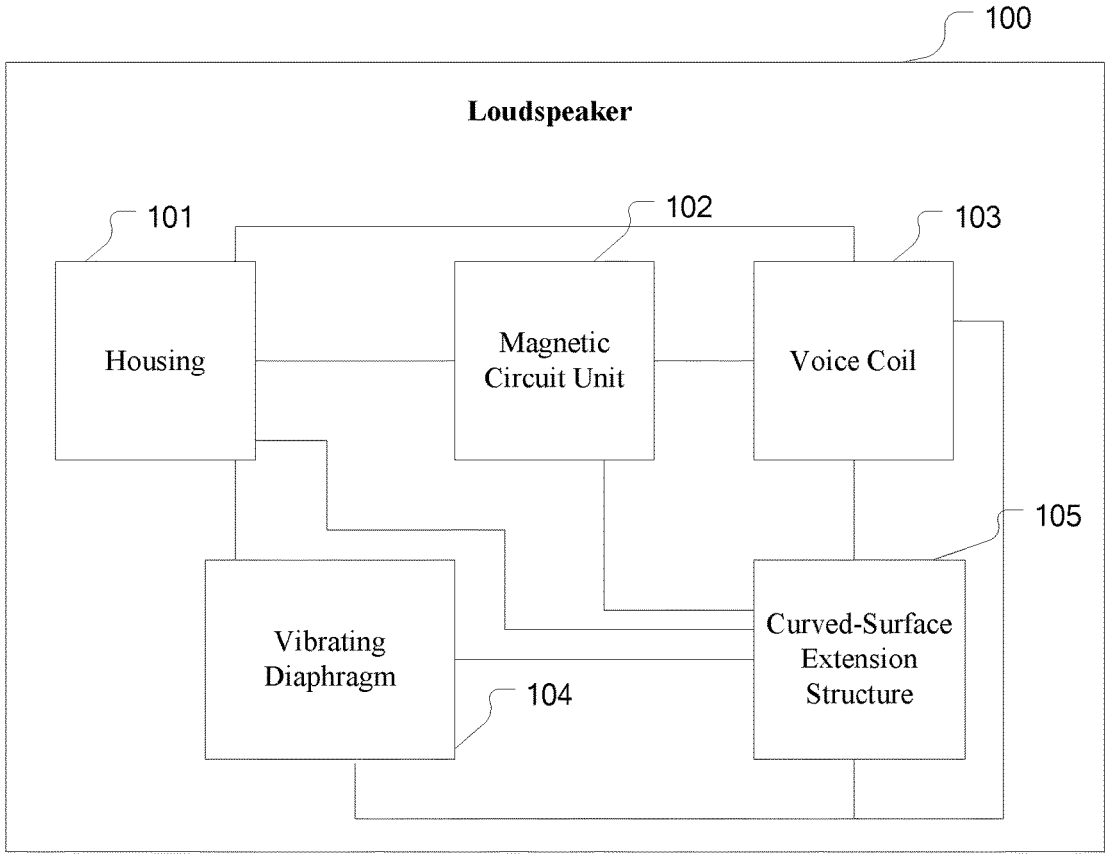
FIG. 1 is a structural block diagram illustrating an exemplary embodiment of a loudspeaker made in accordance with the teachings of the present disclosure.

The following detailed description is merely exemplary in nature and is not intended to limit the invention or the application and uses of the invention. Furthermore, there is no intention to be bound by any theory presented in the preceding background of the invention or the following detailed description.

The exemplary embodiments of the present disclosure will be described in further detail below by referring to the drawings. Although the drawings illustrate the exemplary embodiments of the present disclosure, it should be understood that, the present disclosure can be implemented in various forms, which should not be limited by the embodiments illustrated herein. In contrast, the purpose of providing those embodiments is to more clearly understand the present disclosure, and to completely convey the scope of the present disclosure to a person skilled in the art.

The design concept of the present disclosure is: with respect to the problems of the head-mounted devices such as the sound receiving ends of AR headpieces or VR headpieces in the prior art that the wearing comfortableness is poor, that they cannot provide a good sound immersion feeling and that the privacy of the sound signals is poor, the present disclosure proposes a loudspeaker that has particular directivity. The loudspeaker can be used in a head-mounted device, and, more importantly, the loudspeaker comprises a curved-surface extension structure, and the curved-surface extension structure can radiate the sound generated by the vibrating diaphragm into a predetermined pointing range, thereby improving the privacy in sound receiving, and optimizing the user experience. Furthermore, it is worn comfortably, which can facilitate the head-mounted device in providing a good sound immersing experience, thereby improving the competitiveness of the head-mounted device.

The First Embodiment

FIG. 1 is a structural block diagram of a loudspeaker of an embodiment of the present disclosure. Referring to FIG. 1, the loudspeaker 100 is provided in the head-mounted device, and comprises: a housing 101, a magnetic circuit unit 102 that is provided within the housing 101 and is for generating a magnetic force, a voice coil 103 that vibrates by the magnetic force, and a vibrating diaphragm 104 that in response to the vibration of the voice coil 103 vibrates and generates a sound; wherein the loudspeaker 100 further comprises a curved-surface extension structure 105;

and the curved-surface extension structure 105 connects to the vibrating diaphragm 104, and radiates the sound generated by the vibrating diaphragm 104 into a predetermined directivity range via the curved-surface extension structure 105.

It can be known from the loudspeaker shown in FIG. 1 that, firstly the present disclosure proposes a loudspeaker system that has particular directivity, which solves the problem of traditional externally playing loudspeakers in privacy protection, has good directivity, and focuses the sound into a limited space or even a beam, to achieve the purpose of concentrating the sound energy to enlarge the travelling distance. By using the directivity of the loudspeaker, when it is installed to a head-mounted device it can realize certain privacy protection.

In an embodiment of the present disclosure, the curved-surface extension structure may be an acoustic horn. It should be noted that, traditional specialized high-frequency acoustic-horn loudspeakers are mainly applied in specialized sound amplification fields, and are applied in occasions such as broadcasting, alarming and long-distance transmission (such as theaters). Such specialized acoustic-horn loudspeakers mostly have relatively large volumes, and are not applicable to head-mounted devices, which have limited volumes and spaces. In addition, when such types of loudspeakers are installed in head-mounted devices, the performance indexes of the specialized acoustic-horn loudspeakers cannot be utilized fully, which causes a poor tone quality.

The key to the embodiments of the present disclosure is to improve the structure of the loudspeaker, to improve the directivity when the loudspeaker is applied in a head-mounted device, and in turn improve the privacy in sound receiving during the using of the head-mounted device. Explained below is how to determine the directivity range of the sound of the loudspeaker.

In the present embodiment, the directivity range may be determined by using the following particular steps:

Step 1: the acoustic wave equation in a Cartesian coordinate system is:

$$\frac{\partial^2\phi}{\partial t^2} - c^2\left(\frac{\partial^2\phi}{\partial x^2} + \frac{\partial^2\phi}{\partial y^2} + \frac{\partial^2\phi}{\partial z^2}\right) = 0 \qquad \text{formula (1)}$$

wherein Φ is the solution of the equation, and c is the sound velocity in air.

Step 2: assuming that the acoustic wave transmits in the form of plane wave, wherein the plane wave refers to a wave whose wave fronts are mutually parallel planes, the beam of a plane wave does not diffuse, and the amplitudes of the particles of a plane wave (sound pressure) are a constant, and do not vary with the distance.

Then the above equation is transformed into:

$$\frac{d^2\phi}{dx} + \frac{d\ln s}{dx}\frac{d\phi}{dx} - k^2\phi = 0 \qquad \text{formula (2)}$$

wherein lns is the natural logarithm of the area s, k is the wave number k=2*pai*f/c, and f is the frequency.

Alembert proved that the solution of the equation in the formula (2) may be obtained by superposition and combination of two travelling waves that are respectively forward and backward, so when the length of the curved-surface extension structure is infinitely long, there is no reflected traveling wave. The solution of the equation in the formula (2) is the acoustic impedance of air p/s, wherein the p is the density of the medium.

Step 3: in practical applications, the present embodiment conducts the designing by using a cone-shaped curved-surface extension structure, wherein x0 is the length of the curved-surface extension structure, and the solution of the equation in the formula (2) is:

$$\frac{\rho}{s}\left(\frac{k^2x_0^2 + jkx_0}{1 + k^2x_0^2}\right) \qquad \text{formula (3)}$$

wherein j is the imaginary part, the solution of the equation is the directional angel of the acoustic beam when the curved-surface extension structure is playing a sound, Step 4: making the directional angel of the acoustic beam directly proportional to formula (4)

By the above Steps 1 to 4, the predetermined pointing range of the sound signal radiated by the curved-surface extension structure of the loudspeaker of the present embodiment can be obtained.

Figure 2:
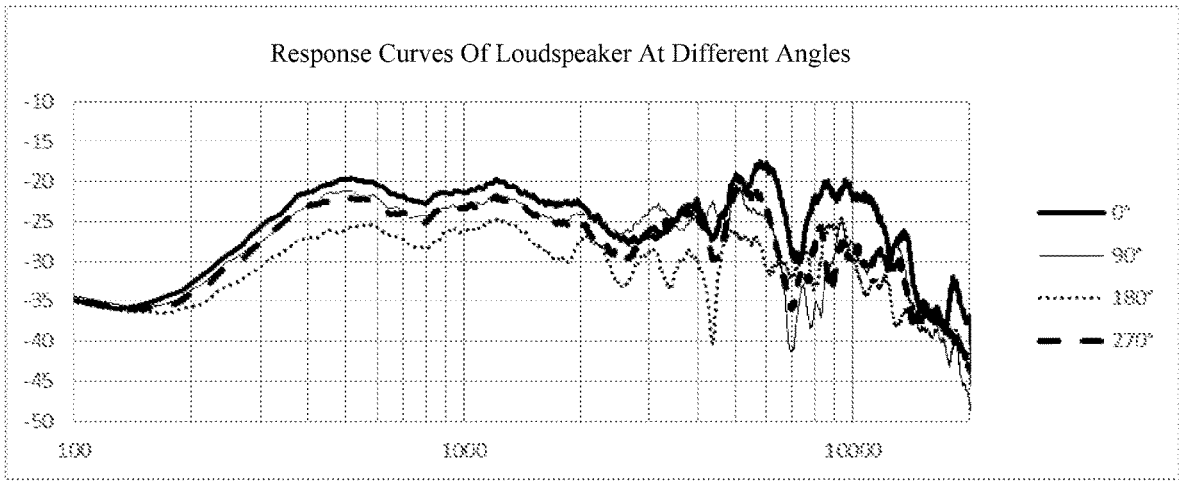
FIG. 2 is a schematic diagram illustrating a test result of directivity of an exemplary embodiment of a loudspeaker made in accordance with the teachings of the present disclosure.

FIG. 2 is a schematic diagram of a test result of directivity of a loudspeaker of an embodiment of the present disclosure. Referring to FIG. 2, the response curves of the loudspeaker at four angles are shown, wherein 0° indicates that the sound directly faces the sound emitting hole of the loudspeaker, 180° indicates that the sound faces away from the loudspeaker, and they have a stable difference. It is proven by testing experiment that, the loudspeaker of the present embodiment has a front sound greater than a back sound, and has good directivity, so that the head-mounted device can realize better sound receiving privacy protection, which optimizes the user experience, and improves the competitiveness of the head-mounted device.

The Second Embodiment

The present embodiment provides a head-mounted device, wherein the head-mounted device comprises an even number of the loudspeakers of the first embodiment; and the loudspeakers are provided at predetermined positions of the head-mounted device and are symmetrical.

Figure 3:
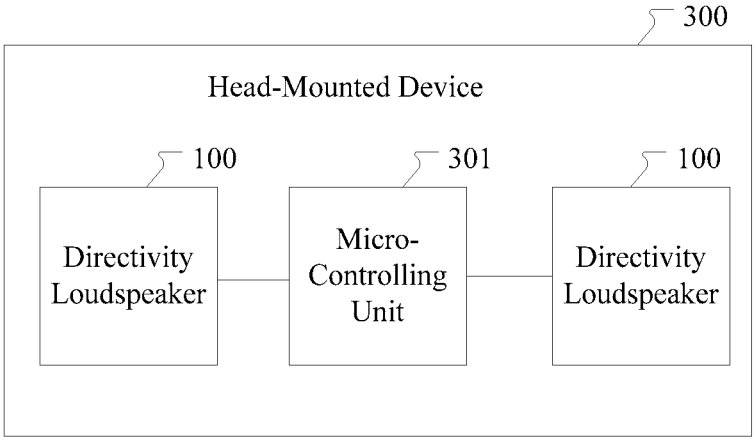
FIG. 3 is a structural block diagram illustrating an exemplary embodiment of a head-mounted device made in accordance with the teachings of the present disclosure.

FIG. 3 is a structural block diagram of a head-mounted device of an embodiment of the present disclosure. Referring to FIG. 3, the head-mounted device 300 comprises: two directivity loudspeakers 100 and a micro-controlling unit 301.

In the present embodiment, the directivity loudspeakers 100 are provided at predetermined positions of the head-mounted device and are symmetrical.

After the head-mounted device 300 is worn to the head of the user, each of the directivity loudspeakers 100, when receiving the controlling signal sent by the micro-controlling unit 301 within the head-mounted device 300, along a predetermined acoustic beam directional angel plays the sound and transmits into the ears of the user.

It should be noted that, the directivity loudspeakers of the present embodiment are the loudspeaker in the above first embodiment, and the loudspeakers are provided therein with a curved-surface extension structure, to improve the directivity of the sound outputted by the loudspeaker.

Referring to FIG. 3, in the present embodiment the loudspeakers are two loudspeakers, and on the basis of the two sound tracks, the head-mounted device of the present embodiment can realize 3D stereophonic immersion-type experience. Particularly, the micro-controlling unit 301 measures in real time an amplitude frequency response A1 and a phase frequency response P1 of each of the loudspeakers that are worn adjacent to an ear of a user, and after the loudspeaker receives a sound signal that has direction information θ1 and distance information Δ1, searches an in-advance-prepared set of Head Related Transfer Function HRTF for an HRTF function that matches the direction information θ1 and the distance information Δ1, and compensates for an acoustic wave outputted by the loudspeaker by using the HRTF function obtained by the searching.

For example, here the HRTF function that matches the direction information θ1 and the distance information Δ1 refers to the HRTF function that is mostly close to the direction information θ1 and the distance information Δ1. Moreover, the process of judging the degree of being close between the HRTF function and the direction information θ1 and the distance information Δ1 may be as follows:

searching an HRTF function set for an HRTF function that is equal to the direction information θ1, and if a plurality of HRTF functions that are equal to the direction information θ1 are found, further comparing those plurality of found HRTF functions with the distance information Δ1, selecting the HRTF function whose distance information has the smallest difference from the distance information Δ1, and using the HRTF function as the HRTF function that is mostly close to the direction information θ1 and the distance information Δ1.

In practical applications, the principle of realizing 3D sound effect is: by binding the direction information and the distance information of the sound with a Human Head Related Transfer Function.

Figure 4:
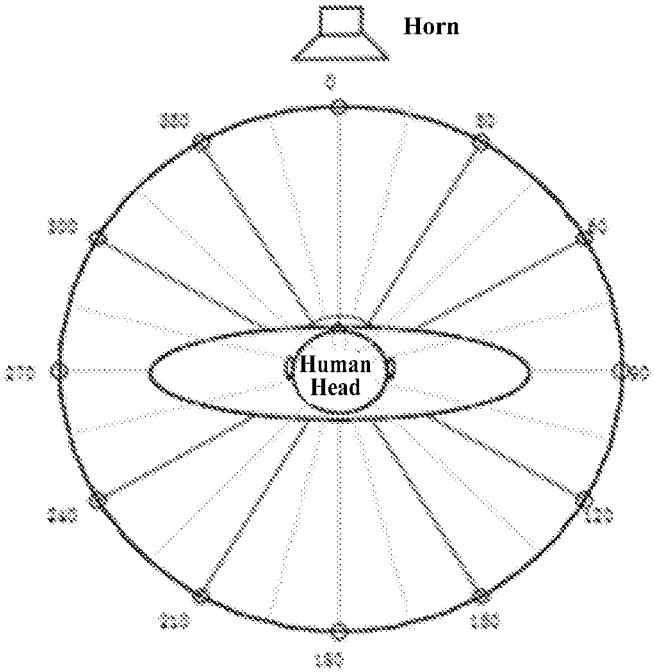
FIG. 4 is a schematic diagram of sound collecting in preparing a Head Related Transfer Function of an exemplary embodiment of the present disclosure.

FIG. 4 is a schematic diagram of sound collecting in preparing a Head Related Transfer Function of an embodiment of the present disclosure. Referring to FIG. 4, the horn conducts sound recording every 15 degrees along the human head (that is, a horn is provided every 15 degrees, and totally 24 horns are provided), and the Head Related Transfer Function HRTF (A, P, θ, Δ) are prepared, wherein the HRTF is a function set of amplitude frequency response, phase frequency response, directional angel and distance. It should be noted that, in practical applications, the spaced angle is not limited to 15 degrees, and the quantity of the employed horns is not limited to 24, which should be particularly designed according to the demand.

After the Head Related Transfer Function HRTF (A, P, θ, Δ) is obtained, it is saved, then in the process of the operation of the head-mounted device the amplitude frequency response A1 and the phase frequency response P1 adjacent to the ears after the loudspeaker is worn are measured, and after a sound signal having direction and distance is received, the mostly close HRTF function is searched and the sound signal is correspondingly compensated for, to enable the loudspeaker arrays of the two ears to realize a three-dimensional sound effect.

Here, the Head Related Transfer Function HRTF is a processing technique for sound locating, and determines, based on a heard sound, the position where the sound is emitted from. Its principle is very complicated. Because the sound is reflected from the auricle or the shoulder to the interior of a human ear, when we uses two horns to simulate sound locating, we can use the computing mode of HD ITD (Inter Aural Time Delay, for short ITD), to calculate the intensity and tones and so on generated by sounds of different direction or positions, and to in turn generate the effect of stereophonic space sound locating. In addition, the HRTF, besides using the two techniques of HD and ITD, further uses the technique of preparing fake human head pickup, to reckon out a stereophonic sound surrounding model, to obtain a sound effect better than that of HD ITD.

It should be noted that, the realizing 3D sound effect in the head-mounted device by using two sound tracks is the prior art, and is not the key to the present embodiment. Therefore, more implementing details regarding realizing 3D sound effect in the head-mounted device by using two sound tracks may be seen in the description in the prior art, which is not discussed here further.

It should be noted that, in the prior art the realizing 3D sound effect on the basis of two sound tracks requires a great deal of complicated computing, to match the mostly close Head Related Transfer Function HRTF, and conduct sound compensating. Therefore, that has a very high requirement on the power consumption of the system, and cannot satisfy the usage demands in specified scenes. In addition, the immersion-type experience of 3D sound effect on the basis of two sound tracks is to be improved. Therefore, in order to obtain more realistic three-dimensional sound effect and reduce the power consumption of the system, on the precondition that the cost and the space of the head-mounted device allow, the present embodiment proposes increasing the quantity of the loudspeakers to four, which are respectively provided at the positions of the head-mounted device that correspond to left front, left rear, right front and right rear of an ear of the user, to realize real multi-track space three-dimensional sound effect of left front, left rear, right front and right rear.

Accordingly, by improving the hardware structure, that is, increasing the quantity of the loudspeakers, and providing the loudspeakers at positions of predetermined directions of the head-mounted device, the present embodiment reduces the calculation amount of the sound direction in matching the mostly close Head Related Transfer Function HRTF, which saves the power consumption of the system.

The Third Embodiment

Figure 5:
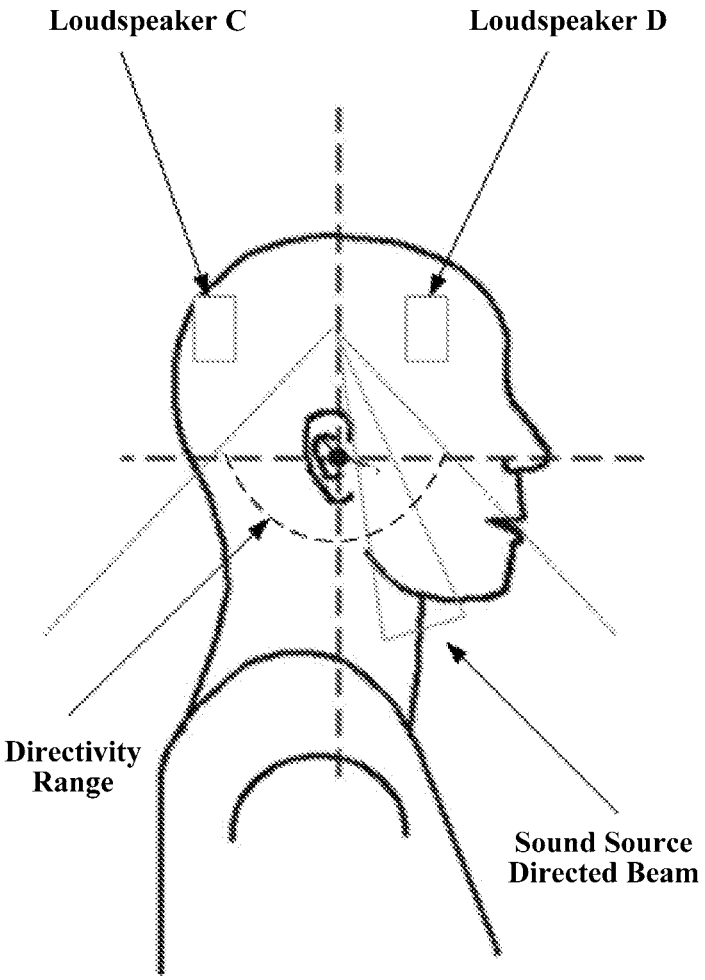
FIG. 5 is a schematic diagram of an optimized directivity of a loudspeaker of an exemplary embodiment of the present disclosure.

In order to further improve the directivity of the sounds on the two sides of the loudspeaker in the head-mounted device, and strengthen privacy protection, the present embodiment proposes the solution of optimizing the directivity of the loudspeakers on the basis of virtual array elements. FIG. 5 is a schematic diagram of an optimized directivity of a loudspeaker of an embodiment of the present disclosure. Referring to FIG. 5, FIG. 5 illustrates a loudspeaker C and a loudspeaker D that are located on the right, and such loudspeakers are loudspeakers that have particular directivity provided in the embodiments of the present disclosure. FIG. 5 illustrates the directivity range of the loudspeaker array formed by the two loudspeakers. Further, the process of optimizing the directivity of the loudspeakers on the basis of virtual array elements comprises: selecting from a loudspeaker A and a loudspeaker B that are located on the left the loudspeaker A, drawing a circle with the loudspeaker B as a circle center and a connecting line of the loudspeaker A and the loudspeaker B as a radius, drawing a reverse direction extension line that passes through the loudspeaker B in a direction of a known sound source, determining a position where a circumference of the circle and the reverse direction extension line intersect as a virtual loudspeaker A' of the loudspeaker A, forming a new array by using the loudspeaker A and the virtual loudspeaker A', defining a directivity angle of the new array as a first collecting angle, and pointing the first collecting angle to a direction that is confirmed by a second collecting angle that has been confirmed as having a voice characteristic in the direction of the known sound source;

and, selecting from a loudspeaker C and a loudspeaker D that are located on the right the loudspeaker C, drawing a circle with the loudspeaker D as a circle center and a connecting line of the loudspeaker C and the loudspeaker D as a radius, drawing a reverse direction extension line that passes through the loudspeaker D in a direction of a known sound source, determining a position where a circumference of the circle and the reverse direction extension line intersect as a virtual loudspeaker C' of the loudspeaker C, forming a new array by using the loudspeaker C and the virtual loudspeaker C', defining a directivity angle of the new array as a third collecting angle, and pointing the third collecting angle to a direction that is confirmed by a fourth collecting angle that has been confirmed as having a voice characteristic in the direction of the known sound source.

It should be noted that, in the present embodiment, the direction or position of the sound source is usually known. For example, in playing a game while wearing the head-mounted device, an object located on the left of the frame in a game scene emits a sound at a certain moment. At this point, the micro-controlling unit of the head-mounted device can acquire the position of the sound source, and send the position information of the sound source to the loudspeaker, and the loudspeaker, according to the position information of the sound source, processes and then outputs a sound source directed beam. Accordingly, the present embodiment realizes that the user can hear the three-dimensional sound generated by the loudspeaker and then know that the object on the left side emits the sound, which enhances the immersion-type experience of the user.

In practical applications, the method can in advance define the directivity range of the loudspeaker, to ensure the privacy in sound receiving, and then by using the loudspeaker array formed by the two loudspeakers on each of the left direction and the right direction, to the direction and position of a known built-in sound source, emit a sound source directed beam that is determined according to the sound source position by the loudspeaker (the part indicated by the triangle in FIG. 5 is the sound source directed beam).

In an embodiment of the present disclosure, the micro-controlling unit in the head-mounted device determines in real time the sound source directed beam of the loudspeaker, and when it is determined that the sound source directed beam exceeds an initial directivity range, regulates the signal amplitude of the loudspeaker, thereby regulating the direction of the sound source directed beam outputted by the loudspeaker, to ensure the directivity of the loudspeaker.

The Fourth Embodiment

The present embodiment provides a method for improving directivity of a sound of a loudspeaker, wherein the loudspeaker comprises: a housing, a magnetic circuit unit that is provided within the housing and is for generating a magnetic force, a voice coil that vibrates by the magnetic force, and a vibrating diaphragm that in response to the vibration of the voice coil vibrates and generates a sound; wherein the method comprises:

providing a curved-surface extension structure in the loudspeaker; and connecting the curved-surface extension structure to the vibrating diaphragm, and radiating the sound generated by the vibrating diaphragm into a predetermined directivity range.

The Fifth Embodiment

The present embodiment provides a method for improving a sound effect of a head-mounted device, wherein the method comprises: providing symmetrically at predetermined positions of the head-mounted device an even number of the loudspeakers that are provided by the first embodiment of the present disclosure.

In an embodiment of the present disclosure, the providing symmetrically at predetermined positions of the head-mounted device an even number of the loudspeakers comprises:

providing the loudspeakers respectively at positions of the head-mounted device that correspond to a left ear and a right ear of a user;

or, providing the loudspeakers respectively at positions of the head-mounted device that correspond to left front, left rear, right front and right rear of an ear of a user.

In an embodiment of the present disclosure, the method further comprises:

measuring in real time an amplitude frequency response A1 and a phase frequency response P1 of each of the loudspeakers that are worn adjacent to an ear of a user, and after the loudspeaker receives a sound signal that has direction information θ1 and distance information Δ1, searching an in-advance-prepared set of Head Related Transfer Function HRTF for an HRTF function that matches the direction information θ1 and the distance information Δ1, and compensating for a sound signal outputted by the loudspeaker by using the HRTF function obtained by the searching.

In an embodiment of the present disclosure, when the loudspeakers are four loudspeakers, the method further comprises:

selecting from a loudspeaker A and a loudspeaker B that are located on the left the loudspeaker A, drawing a circle with the loudspeaker B as a circle center and a connecting line of the loudspeaker A and the loudspeaker B as a radius, drawing a reverse direction extension line that passes through the loudspeaker B in a direction of a known sound source, determining a position where a circumference of the circle and the reverse direction extension line intersect as a virtual loudspeaker A' of the loudspeaker A, forming a new array by using the loudspeaker A and the virtual loudspeaker A', defining a directivity angle of the new array as a first collecting angle, and pointing the first collecting angle to a direction that is confirmed by a second collecting angle that has been confirmed as having a voice characteristic in the direction of the known sound source;

and, selecting from a loudspeaker C and a loudspeaker D that are located on the right the loudspeaker C, drawing a circle with the loudspeaker D as a circle center and a connecting line of the loudspeaker C and the loudspeaker D as a radius, drawing a reverse direction extension line that passes through the loudspeaker D in a direction of a known sound source, determining a position where a circumference of the circle and the reverse direction extension line intersect as a virtual loudspeaker C' of the loudspeaker C, forming a new array by using the loudspeaker C and the virtual loudspeaker C', defining a directivity angle of the new array as a third collecting angle, and pointing the third collecting angle to a direction that is confirmed by a fourth collecting angle that has been confirmed as having a voice characteristic in the direction of the known sound source.

It should be noted that, how to improve the directivity of the loudspeaker array by using virtual array elements may be seen in the description in the prior art, which is not discussed here further.

In addition, the method of the present embodiment further comprises: when it is determined that the sound outputted by the loudspeaker exceeds the initial directivity range, regulating a signal amplitude of the loudspeaker.

In conclusion, the loudspeaker of the embodiments of the present disclosure, by comprising a curved-surface extension structure, which radiates the sound generated by the vibrating diaphragm of the loudspeaker into a predetermined directivity range, compared with the earplug or earmuff system in the conventional head-mounted devices, has a small volume and is comfortable to wear. In addition, compared with traditional externally playing loudspeakers, the directivity is better, which improves the privacy in sound receiving, optimizes the user experience, and, compared with bone conduction earphones, does not affect the head-mounted device in providing a good sound immersion feeling. Furthermore, the present embodiment provides a head-mounted device that comprises the loudspeaker or loudspeaker array of the present embodiment, which, when the head-mounted device is realizing 3D stereo by using the loudspeaker or the loudspeaker array, reduces the calculated amount, thereby saving the power consumption of the system, satisfying the usage demands of certain scenes of high demand on power consumption, and improving the competitiveness of the head-mounted device.

The above are only particular embodiments of the present disclosure. By the teaching of the present disclosure, a person skilled in the art can make other modifications or variations on the basis of the above embodiments. A person skilled in the art should understand that, the above special descriptions are only for the purpose of better explaining the present disclosure, and the protection scope of the present disclosure should be subject to the protection scope of the claims.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A loudspeaker, comprising: a housing, a magnetic circuit unit that is provided within the housing and is for generating a magnetic force, a voice coil that vibrates by the magnetic force, and a vibrating diaphragm that in response to the vibration of the voice coil vibrates and generates a sound; wherein the loudspeaker further comprises a curved-surface extension structure; and the curved-surface extension structure directly attaches to the vibrating diaphragm, and the sound generated by the vibrating diaphragm radiates into a predetermined directivity range via the curved-surface extension structure.

2. A head-mounted device, comprising a micro-controlling unit, wherein the head-mounted device further comprises an even number of the loudspeakers according to claim 1; and the loudspeakers are provided at predetermined positions of the head-mounted device and are symmetrical.

3. The head-mounted device according to claim 2, wherein the loudspeakers are two loudspeakers, and the two loudspeakers are respectively provided at positions of the head-mounted device that correspond to a left ear and a right ear of a user;

or, the loudspeakers are four loudspeakers, and the four loudspeakers are respectively provided at positions of the head-mounted device that correspond to left front, left rear, right front and right rear of an ear of a user.

4. A method for improving a sound effect of a head-mounted device, wherein the method comprises:

providing symmetrically at predetermined positions of the head-mounted device an even number of loudspeakers, each of the loudspeakers comprises: a housing, a magnetic circuit unit that is provided within the housing and is for generating a magnetic force, a voice coil that vibrates by the magnetic force, and a vibrating diaphragm that in response to the vibration of the voice coil vibrates and generates a sound;

providing a curved-surface extension structure in each loudspeaker;

directly attaching the curved-surface extension structure to the vibrating diaphragm in the corresponding loudspeaker, and radiating the sound generated by the vibrating diaphragm into a predetermined directivity range.

5. The method according to claim 4, wherein the step of providing symmetrically at predetermined positions of the head-mounted device an even number of the loudspeakers comprises:

providing the loudspeakers respectively at positions of the head-mounted device that correspond to a left ear and a right ear of a user;

or, providing the loudspeakers respectively at positions of the head-mounted device that correspond to left front, left rear, right front and right rear of an ear of a user.

* * * * *